US006296545B1

(12) United States Patent
Chen

(10) Patent No.: US 6,296,545 B1
(45) Date of Patent: Oct. 2, 2001

(54) FUNCTIONAL BRASSIERE

(76) Inventor: Hui-Mei Chen, No.49, Lane 199, Sanjiun St., Shulin City, Taipei Hsien (TW)

( * ) Notice: Subject to any disclaimer, the term of this patent is extended or adjusted under 35 U.S.C. 154(b) by 0 days.

(21) Appl. No.: 09/692,862

(22) Filed: Oct. 23, 2000

(51) Int. Cl.[7] ..... A41C 3/10
(52) U.S. Cl. ..... 450/38; 450/57; 2/267
(58) Field of Search ..... 250/38, 57, 58; 2/267, 268

(56) References Cited

U.S. PATENT DOCUMENTS

| | | | | |
|---|---|---|---|---|
| 1,250,875 | * | 12/1917 | Heuchan | 450/57 |
| 3,304,558 | * | 2/1967 | Mann | 450/57 |
| 3,401,407 | * | 9/1968 | Pittman | 450/57 |
| 3,494,365 | * | 2/1970 | Beals | 450/38 |
| 5,098,330 | * | 3/1992 | Greenberg | 450/55 |

* cited by examiner

*Primary Examiner*—Gloria M. Hale

(74) *Attorney, Agent, or Firm*—Thomas M. Freiburger

(57) ABSTRACT

The invention relates to a functional brassiere that provides an adjustable engaging strap on the upper periphery of a human body engineered silicone rubber padding. The strap suspends the silicone rubber padding directly by engaging the adjustable engaging strap onto a shoulder strap so that the weight of the lower portion can be shared as well as assuring that the padding will not dislocate and fall due to swaying. The functional brassiere includes a silicone rubber body, a PU film, a seaming cloth, and an adjustable engaging strap, the silicone rubber body being a flexible and elastic body designed according to human body engineering to be a falsie of a "thinner upper portion and thicker lower portion" share suitable for a woman who has had a mammectomy to wear comfortably and fittably so that it will not dislocate and fall due to swaying and can restore the original plump breast and natural arc shape. The PU film is used to coat the silicone rubber body by evacuating the air trapped in the PU film and then hot sealing by a high frequency wave. The adjustable engaging strap is to be provided in the upper peripheries of the silicone rubber padding and seaming cloth. After further fitting and sealing, the functional brassiere with an adjustable engaging strap is thus accomplished.

1 Claim, 3 Drawing Sheets

FUNCTIONAL BRASSIERE

FIELD OF THE INVENTION

The invention relates to a functional brassiere, and in particular, to a functional brassiere having an adjustable engaging strap, wherein said adjustable engaging strap is provided in the peripheries of the silicone rubber padding in a manner that the adjustable engaging strap can be engaged directly on a shoulder strap and can share the weight of the lower portion so as to prevent it from dislocation and falling due to swaying.

BACKGROUND OF THE INVENTION

A conventional functional brassiere 1, as shown in FIG. 1, comprises primarily of a silicone rubber cup body, a PU film and a seaming cloth. When used, a longitudinal adjustable space is formed from the lower periphery of the cup 12 across the corresponding mamma and, by providing an adjustable lifting hole of various sizes; the silicone rubber cup padding 11 in the constraining cup can be adjusted automatically in the transverse space. Since the user wears the brassiere by hanging and covering the cup 12 onto the mamma, the user may feel uncomfortable due to the dislocation or falling of the silicone rubber padding 11 during walking or jumping. In particular, if the user is a woman having subjected to mammectomy and the cup padding 11 is primarily to be used as a falsie, the silicone rubber padding 11 is merely lifted by the cup 12 as modification. However, as the silicone rubber padding 11 is used to substitute the mamma as a whole, since the silicone rubber padding 11 often has a weight in a range of 300 g to 1000 g, and a size in a range of 30A to 50DD, its overweight always causes the silicone rubber padding 11 to fall down and hence becomes an additional burden to the user, as well as will result in a poor appearance and feel unsafe.

Accordingly the above-described conventional article has still many disadvantages, and is not a perfectly designed one that need improved immediately.

In view of the above-mentioned disadvantages associated with the conventional functional brassiere, the inventor devotes to improve and innovate it, and, after studying intensively and persistently for many years, has accomplished the functional brassiere of the invention.

SUMMARY OF THE INVENTION

Accordingly, one object of the invention is to provide a functional brassiere having an adjustable engaging strap.

Another object of the invention is to provide a functional brassiere having an effect as a falsie.

The above-said objects of the invention is achieved by a functional brassiere comprising of a silicone rubber body, a PU film, a seaming cloth, and an adjustable engaging strap, wherein said silicone rubber body is a flexible and elastic body, and is designed according to human body engineering to be a mastectomy bra of a "thinner upper portion and thicker lower portion" shape suitable for a woman having subjected to mammectomy to wear comfortably and fittably so that it will not dislocate and fall due to swaying and can restore the original plump breast and natural arc shape; wherein said PU film is used to coat said silicone rubber body through evacuating the air trapped in said PU film and then hot sealing by a high frequency wave; and wherein said adjustable engaging strap is to be provided in the upper peripheries of said silicone rubber padding and said seaming cloth; and finally, after further fitting and sealing, the functional brassiere having an adjustable engaging strap is thus accomplished.

BRIEF DESCRIPTION OF THE DRAWINGS

The drawings disclose an illustrative embodiment of the present invention that serves to exemplify the various advantages and objects hereof, and are as follows.

SYMBOLS OF MAIN ELEMENTS

Figure 1:
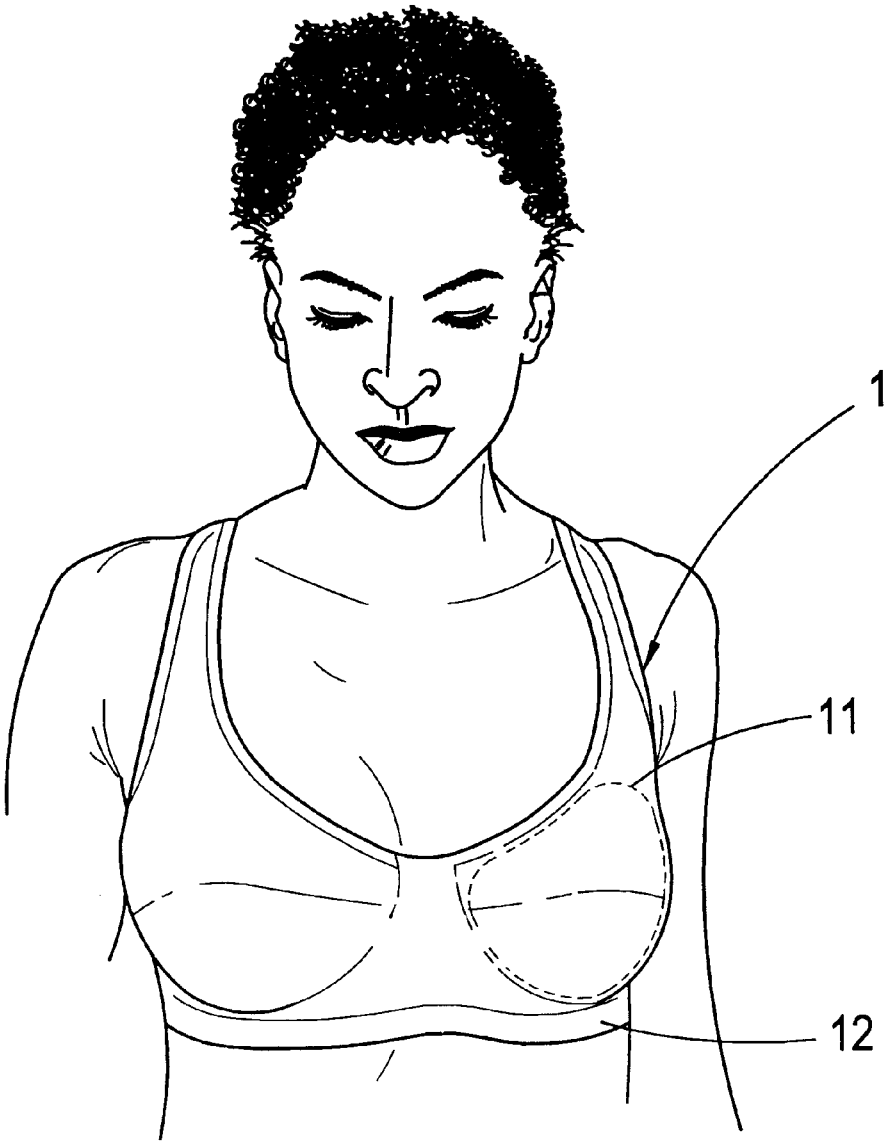
FIG. 1 PRIOR ART
FIG. 1 is a three-dimensional view of a conventional functional brassiere.

11 Silicone rubber padding
12 Cup
2 Functional padding
20 Silicone padding
21 PU film
22 Silicone rubber body
23 An adjustable engaging strap
231 Adjustable buckle
232 Engaging hook
24 Seaming cloth
3 Cup

DETAILED DESCRIPTION OF THE PREFERRED EMBODIMENT

Figure 2A:
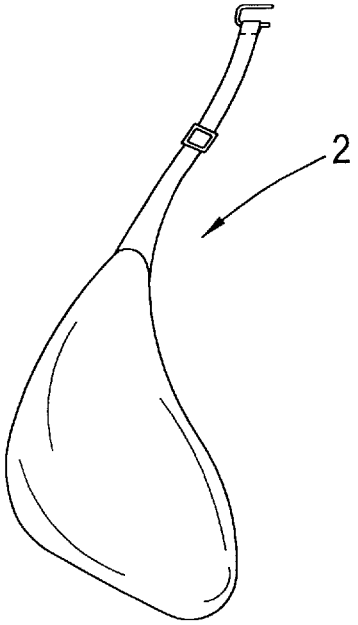
FIG. 2(A) is a three-dimensional side view of a functional brassiere according to the invention.
Figure 2B:
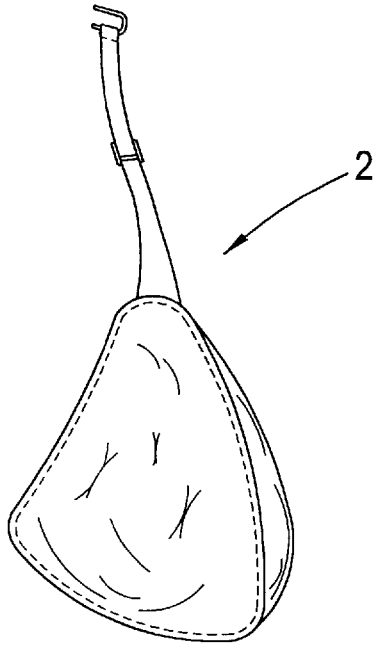
FIG. 2(B) is a three-dimensional rear view of the functional brassiere according to the invention.
Figure 3:
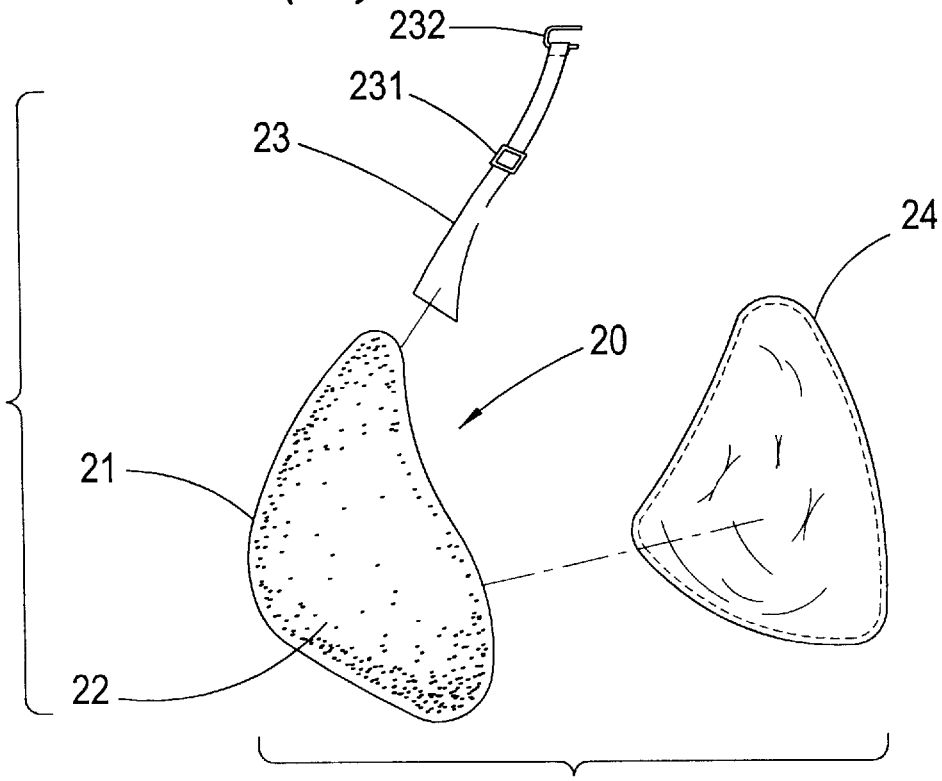
FIG. 3 is an exploded view of the functional brassiere according to the invention.

Referring to FIG. 2(A) and (B), the whole integral structure of the functional brassiere 2 provided by the invention is shown therein, wherein major difference with the conventional one is that an adjustable shoulder strap is provided onto the upper periphery of the silicone rubber padding to hang directly the silicone rubber padding onto the shoulder strap so that the silicone rubber padding will not dislocate or fall down due to walking or jumping and consequently, the user will not feel unsafe. The essential elements of the functional brassiere according to the invention comprise, as shown in the exploded view of FIG. 3, a silicone rubber body 22. a PU film, a seaming cloth 24 and an adjustable engaging strap 23; wherein said silicone rubber body 22 is packed within said PU film 21 into a mamma-like shape and has a flexible property same as a mamma, thereby a silicone rubber padding 20 or falsie is formed; wherein said adjustable engaging strap 23 is provided securely into the fitting space between said seaming cloth 24 and said silicone rubber padding 20 in a manner that said adjustable engaging strap 23 can suspend said silicone rubber padding 20 and hence, when said brassiere is worn, the silicone rubber padding 20 will not fall due to its overweight; and wherein an adjustable buckle 231 that can adjust the length of said adjustable engaging strap 23 is provided on said adjustable engaging strap 23, and an engaging hook 232 is provided at the end of said adjustable engaging strap 23 in a manner that the user can wear simply and promptly by just engaging said adjustable engaging strap with a shoulder strap.

Figure 4A:
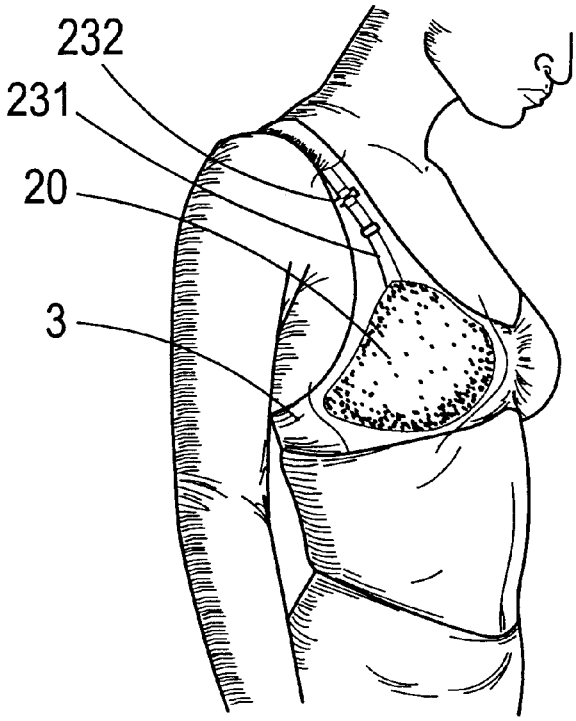
FIG. 4(A) is a side view of an embodiment of the functional brassiere according to the invention.
Figure 4B:
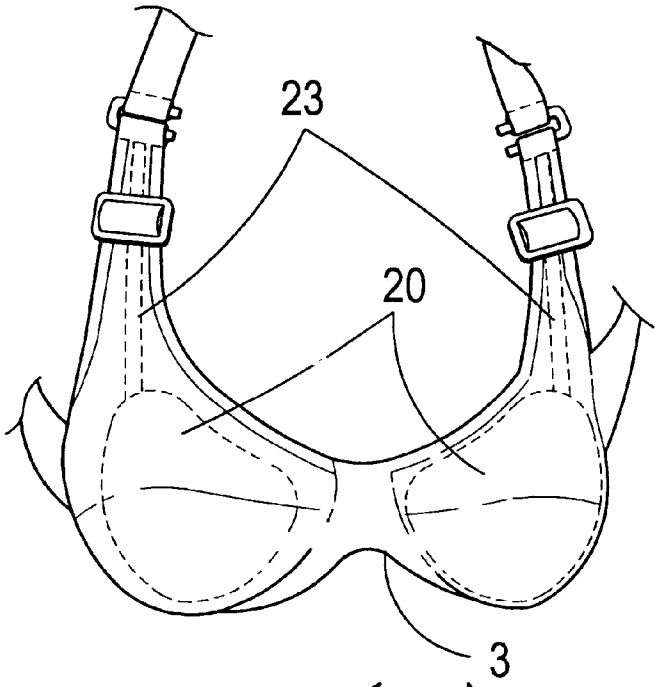
FIG. 4(B) is a front view of an embodiment of the functional brassiere according to the invention.

FIG. 4(A) and (B) show the wearing and the situation after wearing of the functional brassiere according to the invention. Because of the providing of said adjustable engaging strap 23 on said silicone rubber padding 20 or falsie, said silicone rubber padding 21 or falsie can be engaged directly and easily onto a shoulder strap and thereby results in a suspending effect such that the silicone rubber padding 20 will not slide down by the gravity force and hence is safer for the wearer. Here, the function of cup 3 remains only of fixing the position of said silicone rubber padding 20 or falsie to not dislocate by swaying, rather than supporting the silicone rubber padding 20, whereby the sliding down force can be distributed over the shoulder and hence reduce the weight burden on the cup 3.

The functional brassiere provided by the invention has several following advantages over the conventional art:

1. The uncomfortable and unsafe feeling associated with the conventional brassiere due to the dislocation or falling of the silicone rubber padding during walking or jumping can be avoided.
2. The functional brassiere can be a functional brassiere having an effect as a falsie.
3. The functional brassiere according to the invention will not to be unable to suspend the silicone rubber padding due to its overweight.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. In a brassiere which includes a shoulder strap and a cup secured to the shoulder strap, the improvement comprising:

a pad comprising a silicone rubber body, a PU film coating the silicone rubber body, and a seaming cloth on the silicone rubber body, and an adjustable engaging strap secured to the pad, with a length-adjustment buckle and with an engaging hook at an upper end of the engaging strap, the hook being engageable with the shoulder strap, whereby the cup helps retain the position of the pad, but the pad is suspended directly from the shoulder strap so as to distribute the pull of the pad over the shoulder and to reduce the weight retained by the cup.

* * * * *